US010752999B2

(12) United States Patent
Rice et al.

(10) Patent No.: US 10,752,999 B2
(45) Date of Patent: Aug. 25, 2020

(54) HIGH STRENGTH AEROSPACE COMPONENTS

(71) Applicant: Rolls-Royce Corporation, Indianapolis, IN (US)

(72) Inventors: Edward Claude Rice, Indianapolis, IN (US); Maxwell Layman, Indianapolis, IN (US); Robert F. Proctor, Carmel, IN (US); Philip M. Bastnagel, Indianapolis, IN (US); Mark E. Bartolomeo, Brownsburg, IN (US); Jonathan Michael Rivers, Indianapolis, IN (US); Eric Handa, Indianapolis, IN (US); Aaron Martin, Indianapolis, IN (US); Christopher I. Hamilton, Carmel, IN (US); Jonathan P. Acker, Westfield, IN (US); Nathan J. Cooper, Avon, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 562 days.

(21) Appl. No.: 15/458,489

(22) Filed: Mar. 14, 2017

(65) Prior Publication Data

US 2017/0297673 A1 Oct. 19, 2017

Related U.S. Application Data

(60) Provisional application No. 62/324,018, filed on Apr. 18, 2016.

(51) Int. Cl.
*C23C 30/00* (2006.01)
*C25D 7/04* (2006.01)
(Continued)

(52) U.S. Cl.
CPC ..... *C23C 30/00* (2013.01); *C25D 5/00* (2013.01); *C25D 5/18* (2013.01); *C25D 7/04* (2013.01); *C25D 5/56* (2013.01)

(58) Field of Classification Search
None
See application file for complete search history.

(56) References Cited

U.S. PATENT DOCUMENTS 2,644,065 A 6/1953 Peterson
2,992,317 A 7/1961 Miller
(Continued)

FOREIGN PATENT DOCUMENTS

EP 1737652 B1 6/2011
WO 03068673 A2 8/2003
(Continued)

OTHER PUBLICATIONS

U.S. Appl. No. 15/458,458, by Edward Claude Rice, filed Mar. 14, 2017, 28 pp.
(Continued)

*Primary Examiner* — Reginald S Tillman, Jr.
(74) *Attorney, Agent, or Firm* — Shumaker & Sieffert, P.A.

(57) ABSTRACT

An article that includes a structured substrate having a macro-porous structure that defines a plurality of pores, and a metallic nano-crystalline coating on at least a portion of the structured substrate, where the metallic nano-crystalline coating defines an average grain size less than about 20 nanometers.

17 Claims, 7 Drawing Sheets

(51) Int. Cl.

| | |
|---|---|
| ***C25D 5/00*** | (2006.01) |
| ***C25D 5/18*** | (2006.01) |
| *C25D 5/56* | (2006.01) |

(56) References Cited

U.S. PATENT DOCUMENTS

| | | | | |
|---|---|---|---|---|
| 3,288,983 | A | 11/1966 | Lear | |
| 3,597,266 | A | 8/1971 | Leibowitz et al. | |
| 4,628,187 | A | 12/1986 | Sekiguchi et al. | |
| 4,906,515 | A | 3/1990 | Inoguchi | |
| 5,281,091 | A | 1/1994 | Dooley et al. | |
| 5,336,558 | A | 8/1994 | Debe | |
| 5,344,696 | A | 9/1994 | Hastings et al. | |
| 5,352,266 | A | 10/1994 | Erb et al. | |
| 5,371,341 | A | 12/1994 | Ota et al. | |
| 5,925,275 | A | 7/1999 | Lawson et al. | |
| 5,939,146 | A | 8/1999 | Lavernia | |
| 6,037,019 | A | 3/2000 | Kooyer et al. | |
| 6,064,137 | A | 5/2000 | Cox | |
| 6,725,645 | B1 | 4/2004 | Wadia et al. | |
| 7,034,257 | B2 | 4/2006 | Petrenko | |
| 7,354,354 | B2 * | 4/2008 | Palumbo | A01K 87/00 473/320 |
| 7,361,386 | B2 | 4/2008 | Kim et al. | |
| 7,425,255 | B2 | 9/2008 | Detor et al. | |
| 7,771,774 | B2 | 8/2010 | Berckmans, III et al. | |
| 7,824,774 | B2 | 11/2010 | Palumbo et al. | |
| 7,938,368 | B2 | 5/2011 | Hogate | |
| 8,034,459 | B2 | 10/2011 | Wei et al. | |
| 8,105,692 | B2 | 1/2012 | Dumm et al. | |
| 8,197,613 | B2 | 6/2012 | Kerber | |
| 8,247,050 | B2 | 8/2012 | McCrea et al. | |
| 8,314,505 | B2 | 11/2012 | McLoughlin et al. | |
| 8,334,486 | B2 | 12/2012 | Hogate | |
| 8,496,992 | B2 | 7/2013 | Wei et al. | |
| 8,549,832 | B2 | 10/2013 | Maheshwari | |
| 8,581,158 | B2 | 11/2013 | Heintz et al. | |
| 8,753,755 | B2 | 6/2014 | Konyashin et al. | |
| 8,790,789 | B2 | 7/2014 | Ramgopal et al. | |
| 8,790,791 | B2 | 7/2014 | Cheruvu et al. | |
| 8,871,297 | B2 | 10/2014 | Barnett et al. | |
| 8,906,515 | B2 | 12/2014 | Tomantschger et al. | |
| 9,051,881 | B2 | 6/2015 | Bettner | |
| 9,427,835 | B2 | 8/2016 | Cheung et al. | |
| 9,429,029 | B2 | 8/2016 | Macchia et al. | |
| 9,429,077 | B2 | 8/2016 | Morgan | |
| 9,458,729 | B2 | 10/2016 | De Wergifosse et al. | |
| 9,511,572 | B2 | 12/2016 | Cheruvu et al. | |
| 9,587,645 | B2 | 3/2017 | Guglielmin et al. | |
| 2004/0131865 | A1 | 7/2004 | Kim et al. | |
| 2005/0035110 | A1 | 2/2005 | Petrenko | |
| 2005/0205425 | A1 | 9/2005 | Palumbo et al. | |
| 2006/0135282 | A1 | 6/2006 | Palumbo et al. | |
| 2006/0165973 | A1 | 7/2006 | Dumm et al. | |
| 2007/0087185 | A1 | 4/2007 | Wei et al. | |
| 2007/0065638 | A1 | 5/2007 | Wang et al. | |
| 2007/0099027 | A1 | 5/2007 | Krishnamurthy et al. | |
| 2007/0110890 | A1 | 5/2007 | Berckmans, III et al. | |
| 2007/0141370 | A1 | 6/2007 | Kerber et al. | |
| 2009/0081032 | A1 | 3/2009 | Moroso et al. | |
| 2009/0289456 | A1 | 11/2009 | McLoughlin et al. | |
| 2009/0297720 | A1 | 12/2009 | Ramgopal et al. | |
| 2010/0283242 | A1 | 11/2010 | Dooley et al. | |
| 2010/0304065 | A1 | 12/2010 | Tomantschger et al. | |
| 2011/0256356 | A1 * | 10/2011 | Tomantschger | C25D 1/00 428/172 |
| 2011/0256417 | A1 | 10/2011 | Cheruvu et al. | |
| 2011/0287249 | A1 | 11/2011 | Bayer et al. | |
| 2011/0294594 | A1 | 12/2011 | Palumbo et al. | |
| 2012/0082541 | A1 | 4/2012 | Macchia et al. | |
| 2012/0082551 | A1 | 4/2012 | Macchia et al. | |
| 2012/0082553 | A1 | 4/2012 | Eleftheriou et al. | |
| 2012/0082556 | A1 | 4/2012 | Macchia et al. | |
| 2012/0082559 | A1 | 4/2012 | Guglielmin et al. | |
| 2012/0082783 | A1 | 4/2012 | Barnett et al. | |
| 2012/0082806 | A1 | 4/2012 | Kissell et al. | |
| 2012/0148762 | A1 | 6/2012 | Wei et al. | |
| 2012/0167590 | A1 | 6/2012 | Wei et al. | |
| 2012/0167390 | A1 | 7/2012 | Rice | |
| 2012/0237789 | A1 | 9/2012 | Wang et al. | |
| 2013/0055277 | A1 | 2/2013 | Ashish et al. | |
| 2013/0122317 | A1 | 5/2013 | Cheruvu et al. | |
| 2013/0125872 | A1 | 5/2013 | Konyashin et al. | |
| 2013/0139518 | A1 | 6/2013 | Morgan | |
| 2013/0177421 | A1 | 7/2013 | De Wergifosse et al. | |
| 2013/0224008 | A1 | 8/2013 | Cheung et al. | |
| 2013/0255277 | A1 | 10/2013 | Macchia et al. | |
| 2013/0323473 | A1 | 12/2013 | Dietsch et al. | |
| 2014/0004352 | A1 | 1/2014 | McCrea et al. | |
| 2015/0284834 | A1 | 10/2015 | Duval et al. | |
| 2016/0153287 | A1 | 6/2016 | Roach et al. | |
| 2017/0268120 | A1 | 9/2017 | Rice et al. | |
| 2017/0297673 | A1 | 10/2017 | Rice et al. | |
| 2018/0054857 | A1 | 2/2018 | Shuck et al. | |
| 2018/0312976 | A1 | 11/2018 | Wiley et al. | |

FOREIGN PATENT DOCUMENTS

| | | | |
|---|---|---|---|
| WO | 2005100810 | A1 | 10/2005 |
| WO | 2007042081 | A1 | 4/2007 |
| WO | 2015006445 | A1 | 1/2015 |

OTHER PUBLICATIONS

U.S. Appl. No. 15/962,439, filed Apr. 25, 2018, by Wiley et al.
"Graphene composite may keep wings ice-free," Jan. 25, 2016, retrieved from phys.org/news/2016-01-graphene-composite-wings-ice-free.html, 2 pp.
Product Data, "HexFiow VRM37", downloaded from www.hexcel.com on Mar. 29, 2020 (6 pages).

* cited by examiner

HIGH STRENGTH AEROSPACE COMPONENTS

This application claims the benefit of U.S. Provisional Application No. 62/324,018 filed Apr. 18, 2016, which is incorporated herein by reference in its entirety.

TECHNICAL FIELD

The present disclosure relates techniques for forming high strength coated articles for use in aerospace componentry.

BACKGROUND

Aerospace components are often operated in relatively extreme environments that may expose the components to a variety of stresses or other factors including, for example, thermal cycling stress, shear forces, compression/tensile forces, vibrational/bending forces, impact forces from foreign objects, erosion, corrosion, and the like. The exposure of the aerospace components to the variety of stresses, forces, and other factors may impact the lifespan of the component, such as leading to early fatigue or failure. In some examples, aerospace components have been developed that exhibit higher strength and durability using high density metals or metal alloys. However, high density metals or metal alloys are relatively heavy, and may be difficult to manufacture, expensive, or both, making their use non-ideal for aerospace applications.

SUMMARY

In some examples, the disclosure describes an article that includes a structured substrate having a macro-porous structure that defines a plurality of pores, and a metallic nano-crystalline coating on at least a portion of the structured substrate, where the metallic nano-crystalline coating defines an average grain size less than about 20 nanometers.

In some examples, the disclosure describes a structured substrate comprising a metal-based foam or a lattice structure; and a metallic nano-crystalline coating on at least a portion of the structured substrate, wherein the metallic nano-crystalline coating defines an average grain size less than about 20 nanometers.

In some examples, the disclosure describes a method for forming an aerospace component that includes forming a structured substrate having a macro-porous structure that defines a plurality of pores, and depositing a metallic nano-crystalline coating on at least a portion of the structured substrate, where the metallic nano-crystalline coating defines an average grain size less than about 20 nanometers.

The details of one or more examples are set forth in the accompanying drawings and the description below. Other features, objects, and advantages will be apparent from the description and drawings, and from the claims.

DETAILED DESCRIPTION

In general, the disclosure describes aerospace components and techniques for making aerospace components that include a structured substrate (e.g., a structure having a complex three-dimensional shape) having a high strength metallic nano-crystalline coating applied to at least a portion of the structured substrate. The techniques described herein may be used to form aerospace components that exhibit improved strength and reduced weight characteristics compared to conventional nickel, cobalt, titanium, steel, or other relatively high density metal components. Additionally or alternatively, the described techniques may be used to form aerospace components with improved noise and vibrational dampening characteristics which may increase the service life for the component.

Figure 1:
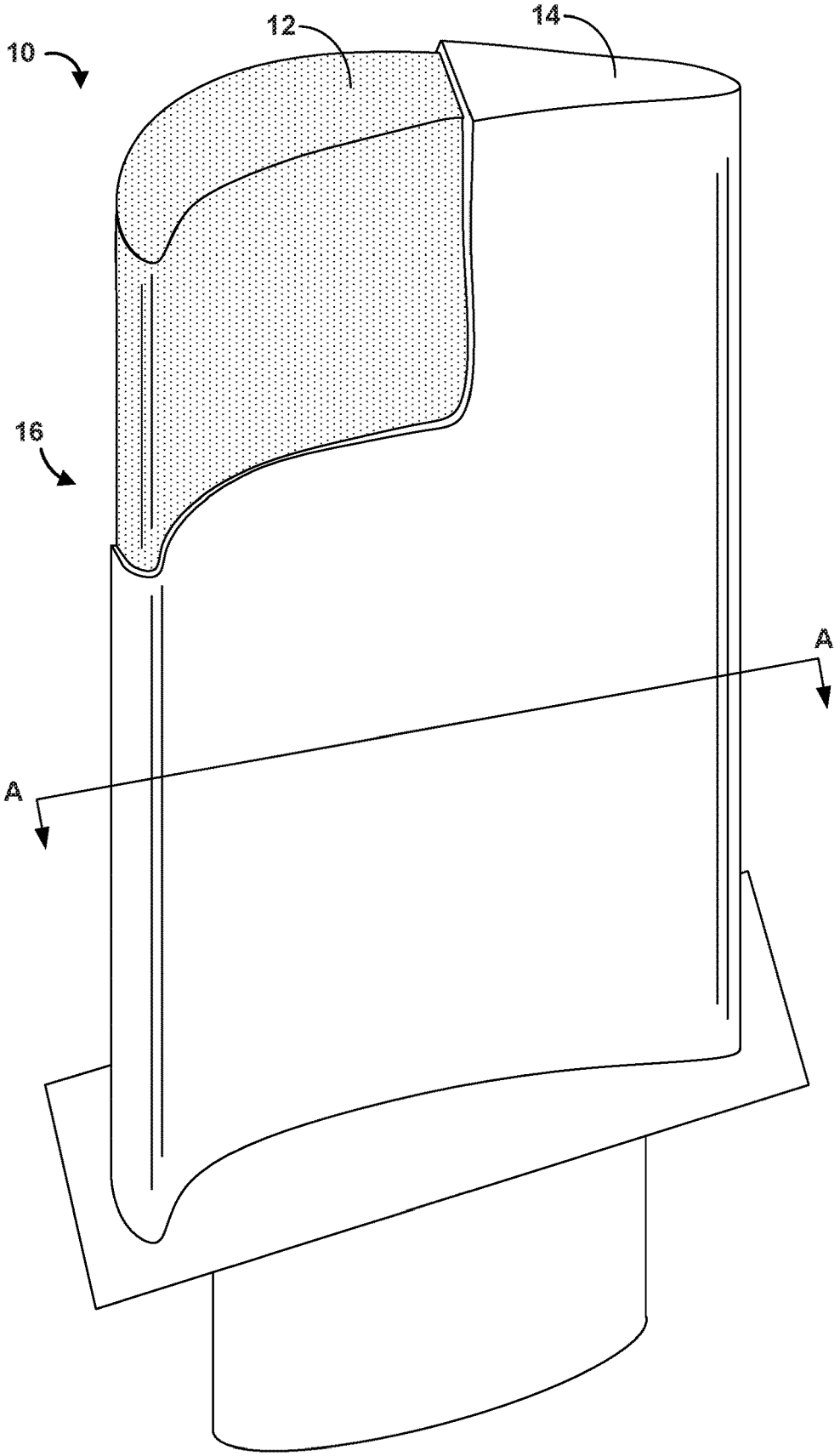
FIG. 1 is a conceptual perspective view of an example component that includes a nano-crystalline coating applied to a structured substrate.
Figure 2:
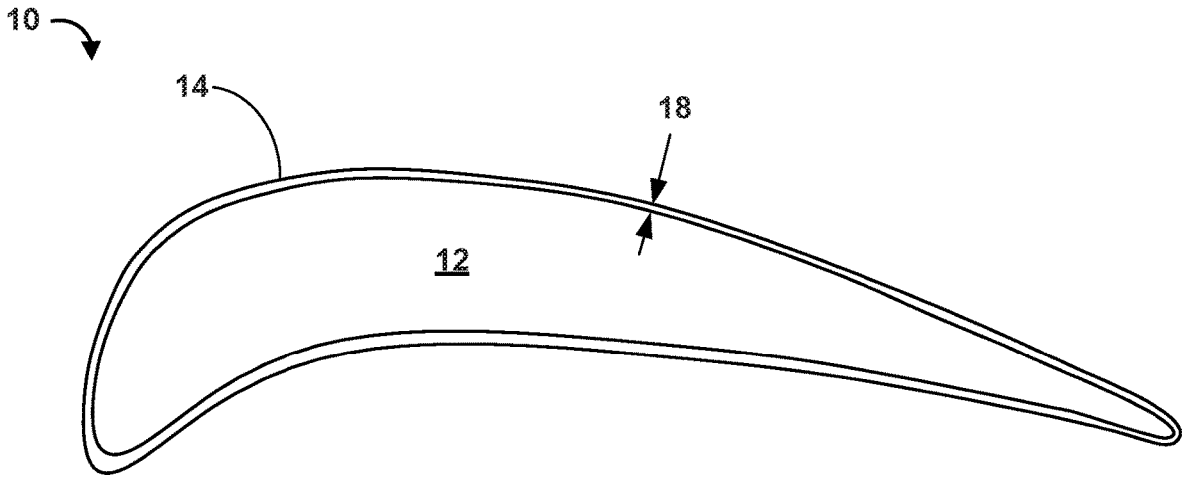
FIG. 2 is a cross-sectional view of the component of FIG. 1 along line A-A.

FIG. 1 is a conceptual perspective view of an example component 10 that includes a nano-crystalline coating 14 applied to a least a portion of a structured substrate 12. FIG. 1 includes a cutout section 16 that reveals structured substrate 12. FIG. 2 provides an alternative cross-sectional view of component 10 of FIG. 1 along line A-A. As shown in FIG. 1, in some examples, component 10 may be in the form of an aerospace component such as a turbine engine blade. However, component 10 may include any aerospace component that may benefit from one or more of the described strength characteristic, reduced weight, or vibrational dampening features. Other aerospace components may include, for example, compressor vanes, housings, brackets, air ducts, manifolds, tubes, chevron ventilation outlets, vane box plume tabs, variable vane actuator arms, nose cones, transition duct seals, actuation rings, airfoils, flaps, casing, frames, accessory gear, drive shafts, rotors, discs, panels, tanks, covers, flow surfaces, turbine engine components, and the like.

In some examples, structured substrate 12 of component 10 may define a relatively complex, relatively light-weight, three-dimensional shape such as a blade for a gas turbine engine that is structurally reinforced and strengthened by the application of at least one metallic nano-crystalline coating 14. In some examples, structured substrate 12 may be a macro-porous material (e.g., a material that includes a plurality of pores, voided spaces, cavities, or the like (collectively referred to as "pores")). In some examples the pores may be about 75 micrometers (μm) to about 500 μm.

For example, structured substrate 12 may include a foam material, a lattice structure, a truss structure, or similar complex three-dimensional structure that includes a plurality of pores.

In some examples, at least some pores of the plurality of pores within structured substrate 12 may be interconnected. In some such examples, the interconnectivity of the at least some pores of the plurality of pores may produce multiple pathways within structured substrate 12 that may extend substantially across the thickness of structured substrate 12 (e.g., pathways that extend between different major surfaces of structured substrate 12). In some examples, the pathways may be used for dissipating heat by allowing a cooling liquid or gas to be circulated through the internal pathways of structured substrate 12. In other examples, at least some pores of the plurality of pores may be only partially interconnected or non-interconnected.

As described further below, in some examples, at least some surfaces of the plurality of pores within structured substrate 12 (e.g., interior portions of structured substrate 12) may be coated with one or more metallic nano-crystalline layers to increase the strength and rigidity of structured substrate 12. Additionally or alternatively, the plurality of pores of structured substrate 12 may be at least partially filled with a polymeric material prior to the application of metallic nano-crystalline coating 14. In some such examples, the polymeric material may be used to improve the smoothness of the exterior surfaces of structured substrate 12, impart vibrational dampening features to structured substrate 12, or both.

In some examples, structured substrate 12 may be constructed from relatively light-weight materials including, for example low density metals such as aluminum, titanium, stainless steel, nickel, cobalt, and the like, metal-based foams, polymeric materials such as polyether ether ketone (PEEK), polyamide (PA), polyimide (PI), bis-maleimide (BMI), epoxy, phenolic polymers (e.g., polystyrene), polyesters, polyurethanes, silicone rubbers, copolymers, polymeric blends, polymer composites such as carbon fiber reinforced PEEK, polymer coated metals, and the like.

Structured substrate 12 may be formed using any suitable technique. For example, structured substrate 12 may be formed using an injection molding process in which one or more base materials are combined and injected into a three-dimensional mold to form structured substrate 12 with the desired three-dimensional geometry. In some examples, structured substrate 12 may be formed using an additive manufacturing process (e.g., three-dimensional printing, directed energy deposition material addition, or the like) or subtractive manufacturing process (e.g., molding or casting followed by subsequent machining). As described further below, the selected technique used to form structured substrate 12 may depend in part on the desired shape, application, and composition of base materials of structured substrate 12.

Metallic nano-crystalline coating 14 of component 10 may include one or more layers of metals or metal alloys that define an ultra-fine-grained microstructure. In some examples, the reduced grain size of metallic nano-crystalline coating 14 may increase the relative tensile strength of the resultant layer as well as the overall hardness of the layer, such that metallic nano-crystalline coating 14 may be significantly stronger and more durable compared to a conventional metallic or alloy coating (e.g., a coarse grained metal or alloy coating) of the same composition and thickness. In some examples, the increased strength and hardness of metallic nano-crystalline coating 14 may allow for the layer to remain relatively thin (e.g., between about 0.025 millimeters (mm) and about 0.15 mm) without sacrificing the desired strength and hardness characteristics of the layer or resultant component 10. Additionally or alternatively, depositing a relatively thin layer of metallic nano-crystalline coating 14 on structured substrate 12 may help reduce the overall weight of component 10 by reducing the volume of denser metals or metal alloys. The combination of the relatively light-weight structured substrate 12 and metallic nano-crystalline coating 14 may result in a relatively high strength, relatively light weight article ideal for aerospace components.

Metallic nano-crystalline coating 14 may define an ultra-fine-grained microstructure having average grain sizes less than about 20 nm. Metallic nano-crystalline coating 14 may include one or more pure metals or metal alloys including, for example, cobalt, nickel, copper, iron, cobalt-based alloys, nickel-based alloys, copper-based alloys, iron-based alloys, or the like deposited on at least a portion of structured substrate 12.

Metallic nano-crystalline coating 14 may be formed using any suitable plating technique, such as electro-deposition. For example, structured substrate 12 may be suspended in suitable electrolyte solution that includes the selected metal or metal alloy for metallic nano-crystalline coating 14. A pulsed or direct current (DC) may then be applied to structured substrate 12 to plate structured substrate 12 with the fine-grained metal to form metallic nano-crystalline coating 14 to a desired thickness and average grain size. In some examples, a pulsed current may be utilized to obtain an average grain size less than about 20 nm.

In some such examples, structured substrate 12 may be initially metalized in select locations with a base layer of metal to facilitate the deposition process of forming metallic nano-crystalline coating 14 on structured substrate 12 using electro-deposition. For example, the metalized base layer on structured substrate 12 may be produced using, for example, electroless deposition, physical vapor deposition (PVD), chemical vapor deposition (CVD), cold spraying, gas condensation, and the like. The layer formed using metallization may include one or more of the metals used to form metallic nano-crystalline coating 14.

In some examples, metallic nano-crystalline coating 14 may be configured to exhibit improved barrier protection against erosion or corrosion compared to traditional materials used for aerospace components. For example, metallic nano-crystalline coating 14 may include a layer of nano-crystalline cobalt. The layer of nano-crystalline cobalt may impart anti-corrosion properties to component 10 as well as increased friction resistance and wear resistance to metallic nano-crystalline coating 14 compared to traditional materials used for aerospace components. In some examples where increased anti-corrosion properties are desired, e.g., on a compressor vane, the relative thickness of metallic nano-crystalline coating 14 may be increased to impart greater anti-corrosion properties on that component.

Additionally or alternatively, metallic nano-crystalline coating 14 may be configured to contribute to the durability of component 10 to resist impact damage from foreign objects during operation. For example, to improve impact damage resistance against foreign objects, aerospace components have traditionally been formed or coated with high strength metals such as titanium. Such techniques, however, may suffer from increased costs associated with processing and raw materials. Additionally, components formed from high strength metals such as titanium tend to result in relatively dense and heavy components which may be less desirable in aerospace applications. Forming component 10 to include structured substrate 12 and metallic nano-crystalline coating 14 (e.g., nano-crystalline nickel) may significantly reduce the weight of the component compared to those formed with traditional high strength metals (e.g., titanium) while also obtaining comparable or even improved impact damage resistance characteristics.

In some examples, the thickness 18 of metallic nano-crystalline coating 14 may be between about 0.025 millimeters (mm) and about 0.15 mm. In some examples, metallic nano-crystalline coating 14 may be about 0.13 mm (e.g., about 0.005 inches). In some examples, the overall thickness 18 of metallic nano-crystalline coating 14 may be selectively varied on different portions of structured substrate 12 to withstand various thermal and mechanical loads that component 10 may be subjected to during operation. For example, in areas where increased impact damage resistance is desired, e.g., the leading edge of a turbine blade, the relative thickness of metallic nano-crystalline coating 14 may be increased to impart greater strength properties in that region. Additionally or alternatively, in regions where increased impact damage resistance is less desired, the thickness 18 of metallic nano-crystalline coating 14 may be reduced, or may be omitted from component 10.

Figure 3:
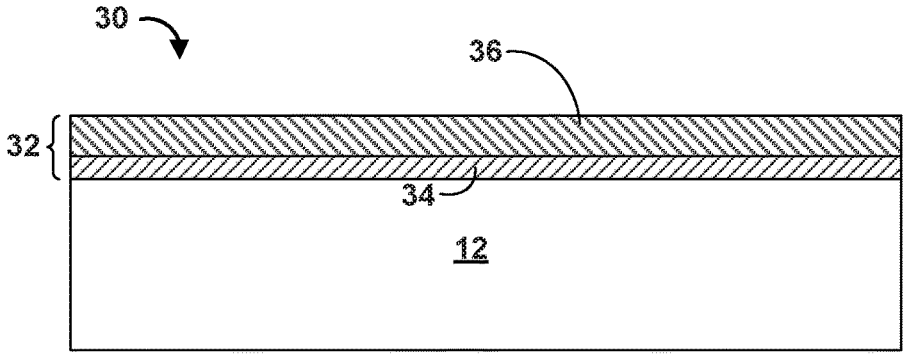
FIG. 3 is a conceptual cross-sectional view of an example article that includes a metallic nano-crystalline coating applied to a structured substrate.

In some examples, metallic nano-crystalline coating 14 may include a plurality of metallic nano-crystalline layers. FIG. 3 is a conceptual cross-sectional view of an example article 30 including structured substrate 12 and a metallic nano-crystalline coating 32 that includes a first metallic nano-crystalline layer 34 and a second metallic nano-crystalline layer 36.

First and second metallic nano-crystalline layers 34 and 36 may be selected to produce a metallic nano-crystalline coating 32 with desired physical, thermal, and chemical (e.g., corrosion resistance) characteristics. For example, first metallic nano-crystalline layer 34 may include nano-crystalline nickel or nickel-based alloy, which may impart high tensile strength properties to metallic nano-crystalline coating 32 to contribute to the overall durability of article 30. As another example, second metallic nano-crystalline layer 36 may include nano-crystalline cobalt or a cobalt-based alloy, which may impart anti-corrosion properties to metallic nano-crystalline coating 32 as well as friction resistance and wear resistance.

The relative thicknesses of first and second metallic nano-crystalline layers 34 and 36 may be substantially the same (e.g., the same or nearly the same) or may be different depending on the composition of the respective layers and intended application of article 30. In some examples in which first metallic nano-crystalline layer 34 includes nickel or a nickel-based alloy and second metallic nano-crystalline layer 36 includes cobalt or a cobalt-based alloy, the relative thicknesses of the layers may be selected such that second metallic nano-crystalline layer 36 is about three times thicker than first metallic nano-crystalline layer 34 (e.g., producing a thickness ratio of about 3:1 cobalt layer to nickel layer). For example, first metallic nano-crystalline layer 34 (which may include nickel or a nickel-based alloy) may have a thickness of about 0.025 mm (e.g., about 0.001 inches) to about 0.038 mm (about 0.0015 inches) and second metallic nano-crystalline layer 36 (which may include cobalt or a cobalt-based alloy) may have a thickness of about 0.075 mm (e.g., about 0.003 inches) to about 0.13 mm (about 0.005 inches) at about a 3:1 thickness ratio. In some examples, the relative thickness of each individual layer may be varied or omitted on different portions of article 30 depending on the desired properties for that portion. For example, for portions of article 30 where increased strength is desired (e.g., a turbine engine blade), the respective metallic nano-crystalline layer comprising nickel (e.g., layer 34) may be relatively thick, while portions of article 30 where increased corrosion resistance is desired (e.g., a compressor vane), the respective metallic nano-crystalline layer comprising cobalt (e.g., layer 36) may be relatively thick. Likewise, for portions of article 30 where the relative strength or corrosion resistance of the metallic nano-crystalline layer is not necessary, the thickness of the respective layer may remain relatively thin or be omitted.

Figure 4A:
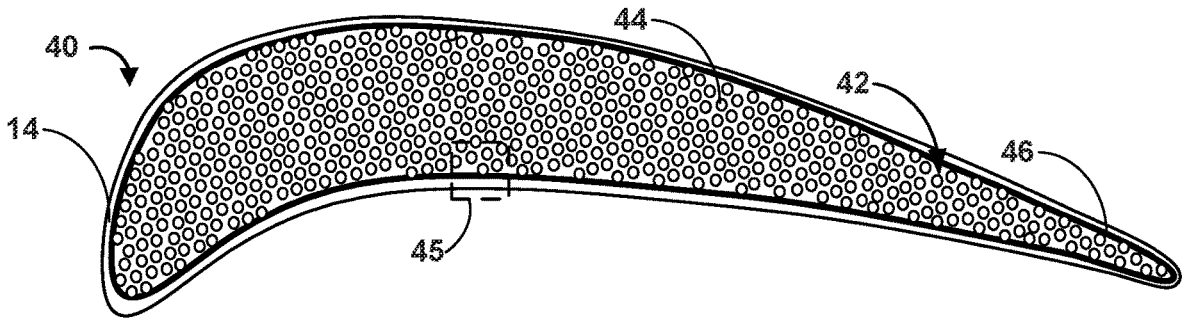
FIG. 4A is a cross-sectional view of an example component (e.g., cross-sectional view of the component of FIG. 1 along line A-A) that includes a metallic nano-crystalline coating on a metal-based foam structured substrate.

In some examples, structured substrate 12 may define a complex three-dimensional structure that includes a plurality of pores, cavities, or voided paces (collectively "pores"). For example, FIG. 4A shows a cross-sectional view (e.g., cross-sectional view of component 10 of FIG. 1 along line A-A) of an example component 40 that includes a metallic nano-crystalline coating 14 on a metal-based foam structured substrate 42 that includes plurality of pores 44. In some examples, the macro-porous structure of metal-based foam structured substrate 42 in conjunction with metallic nano-crystalline coating 14 may allow for significant weight reduction of component 40 without significantly reducing the strength and durability properties of component 40.

Metal-based foam structured substrate 42 may be made using any suitable technique. For example, structured substrate 42 may be formed by combining one or more base metals including, for example, aluminum, titanium, stainless steel, nickel, cobalt, one or more ceramic materials, or the like in a molten state and injected with a gas such as a gas (e.g., nitrogen, argon, or air). As the mixture cools, the molten base metals solidify to produce a metal-based structure that is macro-porous. In another example, the molten base metal may be combined with one or more foaming agents such as, for example, a titanium hydride, calcium carbonate, or the like, which may decompose as the molten mixture solidifies releasing gas which defines the porous structure. In some examples, the molten base metal(s) can be mixed with one or more optional processing aids such as silicon carbide, aluminum-oxide, or magnesium oxide particles to improve the viscosity of the molten mixture. In another example, base-metal powders may be intimately mixed with one or more foaming agent particles and compact into a desired shape. The compact structure may then be heated to the melting point of the base metal, during such heating the foaming agent decomposes releasing gas as the base metal forms a matrix structure. Subsequently, if necessary, the resultant structured substrate 42 may be machined into a desired shape, followed by the application of one or more metallic nano-crystalline coatings 14 as described above.

Figure 4B:
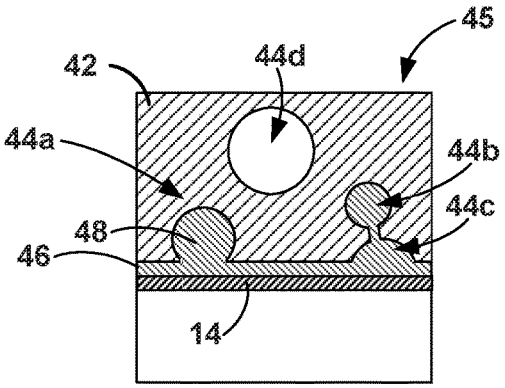
FIG. 4B is an enlargement of a section of FIG. 4A showing the macro-porosity of metal-based foam structured substrate.

FIG. 4B is an example enlargement of section 45 of FIG. 4A showing the macro-porosity of metal-based foam structured substrate 42. Optionally, in some examples, pores 44, (shown in FIG. 4A as open pore 44*a*, open-interconnected pores 44*b* and 44*c*, and closed pore 44*d*) of metal-based foam structured substrate 42 may be partially coated or partially filled with a polymeric material prior to the application of metallic nano-crystalline coating 14. For example, enlargement 45 of FIG. 4A shows pore 44*a*, and interconnected pores 44*b* and 44*c* (collectively pores 44*a*-44*c*) filled with polymeric material 48 such that polymeric material 48 substantially fills (e.g., fills or nearly fills) pores 44*a*-44*c*. While open pore 44*a*, open-interconnected pores 44*b* and 44*c*, and closed pore 44*d* are included in FIG. 4B for illustrative purposes, in some examples, metal-based foam structured substrate 42 may include any combination of pores including, for example, substantially open-interconnected pores throughout the structure (e.g., open-interconnected pores 44*b* and 44*c*), substantially closed pores with open pores on the surface of structured substrate 42 (e.g., open pore 44*a* and closed pore 44*d*), or a combination of both.

Polymeric material 48 may include one or more polymer materials including for example, PEEK, PA, PI, BMI, epoxy, phenolic polymers, polyesters, polyurethanes, silicone rubbers, copolymers thereof, polymeric blends thereof, and the like. In some examples, polymeric material 48 may also coat one or more external surfaces of metal-based foam structured substrate 42 to form a layer of polymeric material 46 on select portions structured substrate 42. In some such examples, polymeric material 48 may help smooth the exterior surface of metal-based foam structured substrate 42, which may in turn allow for a more uniform thickness and application of metallic nano-crystalline coating 14 on structured substrate 42.

Depending on the intended use for component 40, the application of polymeric material 48 on metal-based foam structured substrate 42 may impart vibrational dampening characteristics to component 40. For example, conditions in which component 40 is typically operated (e.g., aerospace applications), may exert one or more vibrational forces on the component which may cause the component to resonate during operation. The resonance of the component may lead to increased noise and over an extended period of time may cause early fatigue of the component. The applied vibrational forces are a particular concern for gas turbine engine components that are subjected to turbulent air flow which can generate the described vibrational forces, or other vibrational forces from other engine components (e.g., combustor, driveshafts, and the like). In such instances, it may be desirable for component 40 to possess a natural resonance frequency outside the range or otherwise dampen the vibrational frequencies anticipated to be exerted on the component during operation. In some examples, the inclusion of polymeric material 48 on metal-based foam structured substrate 42 may allow for partial relative motion between metal-based foam structured substrate 42 and one or more of polymeric material 48 (including layer of polymeric material 46) and metallic nano-crystalline coating 14 during operation of component 40. The relative motion may allow for the vibrations exerted on component 40 during operation to be dissipated by the relative motion, resulting in improved vibrational dampening properties of component 40. Additionally or alternatively, the inclusion of polymeric material 48 may alter the natural resonance frequency of component 40, such that the natural resonance frequency of component 40 lies outside the range of vibrational frequencies anticipated during operation.

Figure 5:
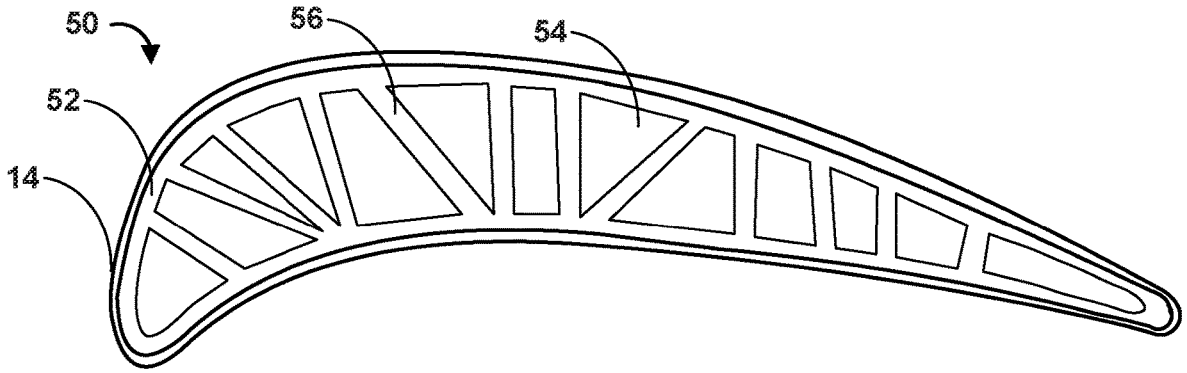
FIG. 5 is a cross-sectional view of an example component (e.g., cross-sectional view of the component of FIG. 1 along line A-A) that includes a structured substrate that includes a truss structure.

In some examples, the structured substrate may be constructed as a truss structure. For example, FIG. 5 is a conceptual cross-sectional view of an example component 50 (e.g., along cross-section line A-A from FIG. 1). Component 50 includes structured substrate 52 and metallic nano-crystalline coating 14 on at least a portion of structured substrate 52. In some examples, structured substrate 52 may be formed with a plurality of truss connections 56 that form an exoskeleton structure defining a plurality of pores 54 (e.g., cavities or voided spaces).

In some examples, structured substrate 52, including truss connections 56, may be formed using any one of the metals, metal alloys, polymeric materials, polymer composite material, or combinations thereof as described above. The truss structure of structured substrate 52 may be formed using any suitable technique including, for example, additive manufacturing, molding, casting, and machining. In some examples, the truss structure of structured substrate 52 in conjunction with metallic nano-crystalline coating 14 may allow for significant weight reduction of component 50 without significantly reducing the strength and durability properties of component 50.

In some examples, one or more of the internal pores 54 (e.g., cavities or voided spaces) of structured substrate 52 may be coated with a metallic nano-crystalline coatings (not shown) to further enhance the strength and durability properties of component 50 using, for example, the electrodeposition techniques described above. Additionally or alternatively, pores 54 of structured substrate 52 may be at least partially filled with a polymeric material (not shown), which may impart vibrational dampening attributes to component 50 without significantly increasing the overall weight of component 50.

Figure 6A:
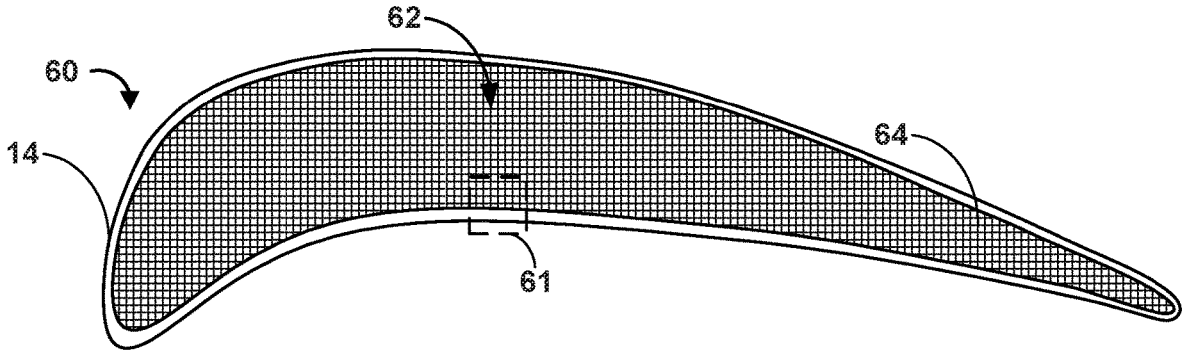
FIG. 6A is a cross-sectional view of an example component (e.g., cross-sectional view of the component of FIG. 1 along line A-A) that includes a structured substrate that includes a lattice structure.

FIG. 6A is cross-sectional view (e.g., cross-sectional view of component 10 of FIG. 1 along line A-A) of another example component 60 that includes a nano-crystalline coating 14 on structured substrate 62, which defines a lattice structure that includes a plurality of pores 64 (e.g., the voided spaces within the lattice of structured substrate 62). The lattice structure of structured substrate 62 may provide a relatively light-weight complex three-dimensional structure with a high ratio of voided space to solid material such that the lattice structure of structured substrate 62 in conjunction with metallic nano-crystalline coating 14 may allow for significant weight reduction of component 60 without significantly reducing the strength and durability properties of component 60. Additionally or alternatively, in some examples where the pores 64 of structured substrate 62 are interconnected, the lattice structure may provide a high degree of internal surface area that assist with cooling capabilities wherein a cooling gas can be circulated through the interconnected pores 64 of structured substrate 62 to dissipate heat from one or more exterior surfaces of component 60.

In some examples, the lattice structure of structured substrate 62 may be formed using, for example, additive manufacturing techniques. For example, structured substrate 62 may be formed using a three-dimensional additive manufacturing technique such as a directed energy deposition material addition where a base material such as a polymer, metal, or metal alloy is used to produce a multi-layered, light-weight, open-pored lattice structure. In some examples, using additive manufacturing techniques may allow for a high degree of uniformity and control over one or more of the size of pores 64, the disbursement of pores 64 within structured substrate 60, and the volumetric ratio between the base materials and pores 64. In some examples, structured substrate 62 may define a cube-lattice structure where the pores define a cross-sectional dimension of about 1 millimeter (mm) to about 20 mm.

In some examples the base material used to form the lattice of structured substrate 62 may include metals such as aluminum, titanium, stainless steel, nickel, cobalt, and the like; metal alloys; ceramic materials; or polymeric materials such as PEEK, PA, PI, BMI, epoxy, phenolic polymers, polyesters, polyurethanes, silicone rubbers, copolymers thereof, polymeric blends thereof, composites thereof, and the like.

Figure 6B:
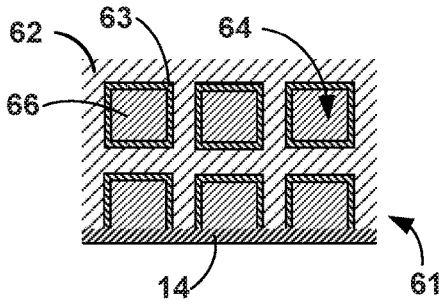
FIG. 6B is an enlargement of a section of FIG. 6A showing the macro-porosity of the lattice structure of the structured substrate.

In some examples, after forming structured substrate 62, interior portions of the lattice network of structured substrate 62 may be coated with one or more optional metallic nano-crystalline layers and/or partially filled with a polymeric material prior to the application of metallic nano-crystalline coating 14 to the exterior of structured substrate 62. For example, FIG. 6B is an enlargement of section 61 of FIG. 6A showing structured substrate 62 that having a plurality of pores 64 that include an optional metallic nano-crystalline layer 63 applied to interior portions of the lattice structure of structured substrate 62. In some such examples, metallic nano-crystalline layer 63 may provide increased strength and rigidity to structured substrate 62 and resultant component 60. Metallic nano-crystalline layer 63 may include any of the nano-crystalline layers described herein, such as nano-crystalline layers based on nickel, nickel alloys, cobalt, cobalt alloys, copper, copper alloy, iron, iron alloys, or the like.

Additionally or alternatively, at least some pores of plurality of pores 64 of structured substrate 62 may be at least partially filled with a polymeric material 66 (e.g., PEEK, PA, PI, BMI, epoxy, phenolic polymers, polyesters, polyurethanes, silicone rubbers, copolymers thereof, polymeric blends thereof, and the like) prior to the application of metallic nano-crystalline coating 14. Polymeric material 63 may help smooth the exterior structured substrate 62, which may in turn allow for a more uniform thickness and application of metallic nano-crystalline coating 14 on structured substrate 62. Polymeric material 63 may also impart vibrational dampening attributes to component 60 as described above without significantly increasing the overall weight of component 60.

Figure 7:
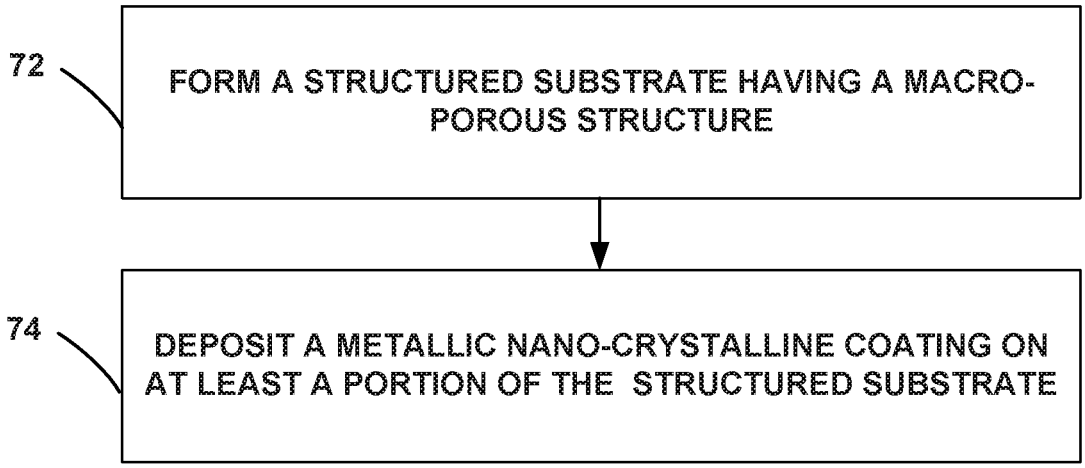
FIGS. 7-9 are flow diagrams illustrating example techniques for forming an example article that includes a metallic nano-crystalline coating on a structured substrate.
Figure 8:
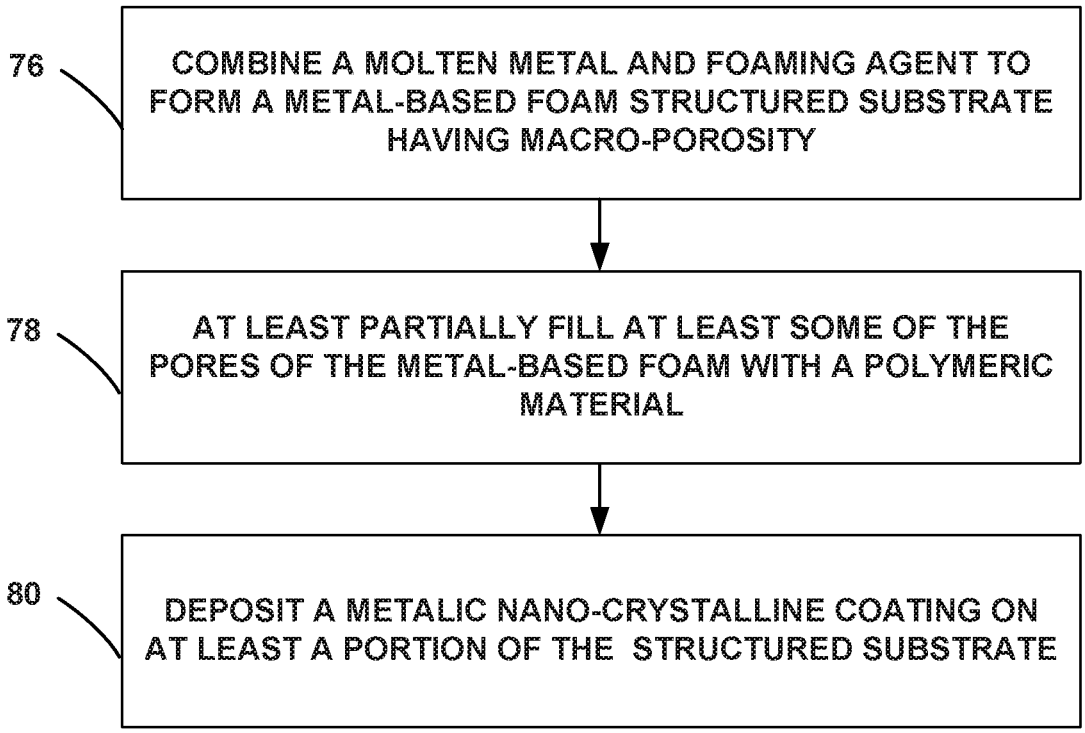
Figure 9:
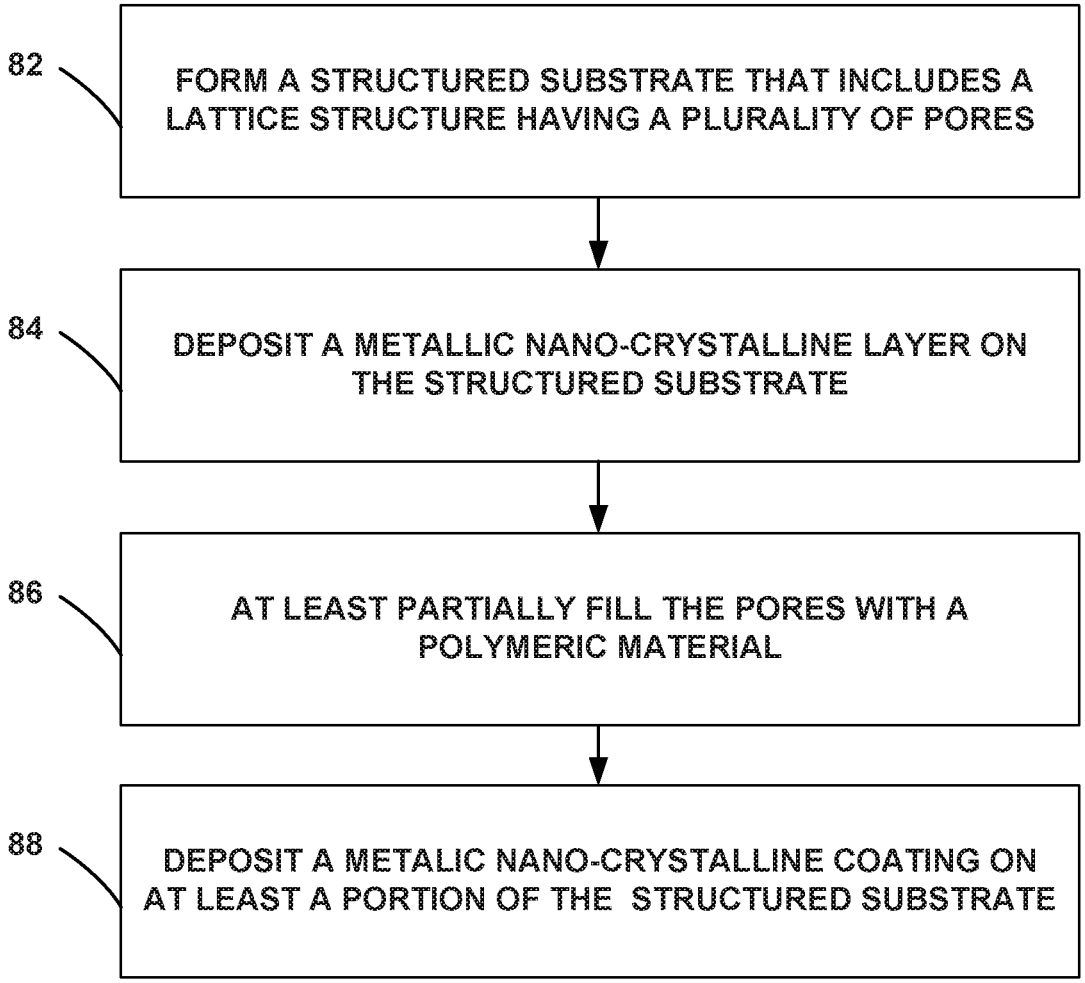

FIGS. 7-9 are flow diagrams illustrating example techniques for forming an example article that includes a metallic nano-crystalline coating on a structured substrate. While the techniques of FIGS. 7-9 are described with concurrent reference to the conceptual diagrams of FIGS. 1-6, in other examples, the techniques of FIGS. 7-9 may be used to form other articles and aerospace components, the articles and components of FIGS. 1-6 may be formed using a technique different than that described in FIGS. 7-9, or both.

The technique of FIG. 7 includes forming a structured substrate 12 having a macro-porous structure (72) and depositing a metallic nano-crystalline coating 14 on at least a portion of the structured substrate 12 (74). As described above, structured substrate 12 may include a foam material (e.g., metal-based foam structured substrate 42), a truss structure (e.g., structured substrate 52), a lattice structure (e.g., structured substrate 62), or similar complex three-dimensional design structure that includes a plurality of pores. Structured substrate 12 may be formed using any suitable technique including, for example, foam production processing, additive or subtractive manufacturing techniques (e.g., directed energy deposition material addition, weld assembly, molding, machining), or the like. The selected technique used to form structured substrate 12 may depend in part on the desired shape, application, and composition of base materials of structured substrate 12.

In some examples, structured substrate 12 optionally may be at least partially coated or infiltrated with a polymeric material (e.g., polymeric materials 28 and 66) or a metallic nano-crystalline layer (e.g., metallic nano-crystalline layer 63) prior to the application of metallic nano-crystalline coating 14 (74). In some such examples, the polymeric material may be used to smooth the exterior surface of structured substrate 12 or impart vibrational dampening characteristics to structured substrate 12 and the metallic nano-crystalline layer 14 may provide additional strength and rigidity to structured substrate 12.

The technique of FIG. 7 includes depositing a metallic nano-crystalline coating 14 on at least a portion of the structured substrate 12 (74). As described above, metallic nano-crystalline coating 14 may include one or more layers of nano-crystalline metal (e.g., nickel, cobalt, copper, iron, or the like) or metal alloy (e.g., nickel-based alloy, cobalt-based alloy, copper-based alloy, iron-based alloy, or the like) that defines an ultra-fine-grained microstructure with an average grain size less than about 20 nanometers (nm). The metallic nano-crystalline coating 14 may be applied using an electro-deposition process (e.g., pulse electro-deposition using an electrolyte bath). In some examples, structured substrate 12 may be initially metalized if needed to aid in the deposition of metallic nano-crystalline coating 14.

In some examples, the metallic nano-crystalline coating may be deposited (74) as two or more metallic nano-crystalline layers with different metallic compositions. For example, as described with respect to FIG. 3, the metallic nano-crystalline coating 32 may include a first metallic nano-crystalline layer 34 including primarily nano-crystalline cobalt and a second metallic nano-crystalline layer 36 including primarily nano-crystalline nickel. In some examples, the two or more metallic nano-crystalline layers may be constructed to have differing thicknesses.

In some examples, the macro-porosity of structured substrate 12 in conjunction with metallic nano-crystalline coating 14 may allow for significant weight reduction of component 10 without significantly reducing the strength and durability properties of component 10. Additionally or alternatively, the overall thickness 18 of the metallic nano-crystalline coating 14 as measured normal to an exterior surface of the structured substrate 12 may be selectively varied on different regions of structured substrate 12 to tailor the strength, impact-resistance, corrosion-resistance, or other characteristics within the different regions of component 10.

FIG. 8 is another example technique that includes combining a molten metal and one or more foaming agents to form a metal-basted foam structured substrate 42 having a macro-porous structure (76) and depositing a metallic nano-crystalline coating 14 on at least a portion of the structured substrate 42 (80). As described above, metal-based foam structured substrate 42 may be formed using any suitable technique including, for example, by combining one or more base metals with a foaming agent such as, for example, a titanium hydride. The foaming agent may be added to the molten base metal and cast into a desired shape or, in some examples, mixed with the base metals in particle form and compacted into a desired shape and subsequently heated to transform one or more of the based metals into a molten state. The foaming agent may degrade during the process to release gas as the molten base metals cool and solidify to form a metal-based foam structured substrate 42 that is macro-porous. If necessary, the resultant structured substrate 42 may be machined into a desired shape prior to depositing metallic nano-crystalline coating 14 on at least a portion of the structured substrate 42 (80). Metallic nano-crystalline coating 14 may be applied using an electro-deposition process as described above, and may include one or more layers of nano-crystalline metal or metal alloy that define an ultra-fine-grained microstructure.

The technique of FIG. 8 also includes the optional step of at least partially filling pores 44 of the metal-based foam structured substrate 42 with a polymeric material 48 (78) prior to the deposition of metallic nano-crystalline coating 14 (80). As described above, the polymeric material 48 may include PEEK, PA, PI, BMI, epoxy, phenolic polymers, polyesters, polyurethanes, silicone rubbers, copolymers thereof, polymeric blends thereof, and the like. In some examples, polymeric material 48 may help smooth the exterior surface of metal-based foam structured substrate 42, which may in turn allow for a more uniform thickness and application of metallic nano-crystalline coating 14 on structured substrate 42.

FIG. 9 is another example technique that includes forming a structured substrate 62 that includes a lattice structure having a plurality of pores 64 (82) and depositing a metallic nano-crystalline coating 14 on at least a portion of the structured substrate 42 (88). As described above, structured substrate 62 include metals, metal alloys, or polymeric materials and may be formed using an additive manufacturing process. Metallic nano-crystalline coating 14 may be applied using an electro-deposition process as described above, and may include one or more layers of nano-crystalline metal or metal alloy that define an ultra-fine-grained microstructure.

The technique of FIG. 9 also includes an optional step of depositing one or more metallic nano-crystalline layers 63 on the structured substrate 62 (84) prior to the deposition of metallic nano-crystalline coating 14 (88). The one of more metallic nano-crystalline layers 63 may be deposited using techniques similar to the application metallic nano-crystalline coating 14 to increase the rigidity and strength of structured substrate 62 prior to the application of nano-crystalline coating 14.

The technique of FIG. 9 also includes an optional step of at least partially filling pores 64 of the structured substrate 62 with a polymeric material 66 (86) prior to the deposition of metallic nano-crystalline coating 14 (88). As described above, the polymeric material 66 may include PEEK, PA, PI, BMI, epoxy, phenolic polymers, polyesters, polyurethanes, silicone rubbers, copolymers thereof, polymeric blends thereof, and the like. In some examples, polymeric material 66 may be applied to smooth the exterior surface of structured substrate 62 or impart vibrational dampening characteristics to structured substrate 62.

Various examples have been described. These and other examples are within the scope of the following claims.

What is claimed is:

1. An article comprising:

a structured substrate having a macro-porous structure that defines a plurality of pores; and a metallic nano-crystalline coating on at least a portion of the structured substrate, wherein the metallic nano-crystalline coating defines an average grain size less than about 20 nanometers, wherein the metallic nano-crystalline coating comprises an overall thickness measured normal to an exterior surface of the structured substrate, and wherein the overall thickness is selectively varied on different regions of the structured substrate.

2. The article of claim 1, wherein the article comprises an aerospace component comprising at least one of a compressor vane, a turbine blade, a rotor, a disc, a housing element, a bracket, a chevron ventilation outlet, a vane box plume tab, a variable vane actuator arm, a nose cone, an airfoil, a flap, an accessory gear, or an air-flow surface.

3. The article of claim 1, wherein the structured substrate comprises a metal-based foam, a lattice structure, or a truss structure.

4. The article of claim 1, wherein the structured substrate comprises one or more metals selected from the group consisting of aluminum, titanium, stainless steel, nickel, or cobalt.

5. The article of claim 1, wherein the structured substrate comprises a polymer selected from the group consisting of a polyether ether ketone (PEEK), a polyamide (PA), a polyimide (PI), a bis-maleimide (BMI), an epoxy, a phenolic polymer, a polyester, a polyurethane, or a silicone rubber.

6. The article of claim 1, further comprising a polymeric material, wherein the polymeric material at least partially fills the plurality of pores.

7. The article of claim 1, wherein the metallic nano-crystalline coating comprises:

a first layer comprising nano-crystalline cobalt defining a first thickness; and a second layer comprising nano-crystalline nickel defining a second thickness, wherein the first thickness is greater than the second thickness.

8. An article comprising:

a structured substrate comprising a metal-based foam or a lattice structure, wherein the structured substrate comprises at least one of:

a metal selected from the group consisting of aluminum, titanium, stainless steel, nickel, or cobalt, or a polymer selected from the group consisting of a polyether ether ketone (PEEK), a polyamide (PA), a polyimide (PI), a bis-maleimide (BMI), an epoxy, a phenolic polymer, a polyester, a polyurethane, or a silicone rubber; and a metallic nano-crystalline coating on at least a portion of the structured substrate, wherein the metallic nano-crystalline coating defines an average grain size less than about 20 nanometers, and wherein the metallic nano-crystalline coating includes one or more layers comprising a nano-crystalline metal selected from the group consisting of cobalt, nickel, copper, iron, cobalt-based alloy, nickel-based alloy, copper-based alloy, or iron-based alloy.

9. The article of claim 8, wherein the structured substrate comprises the metal-based foam comprising a plurality of pores, the article further comprising a polymeric material deposited on the metal-based foam, wherein the polymeric material at least partially fills the plurality of pores.

10. The article of claim 9, wherein the polymeric material forms a layer on the metal-based foam between the metallic nano-crystalline coating and the metal-based foam.

11. The article of claim 8, wherein the structured substrate comprises the lattice structure, the article further comprising a metallic nano-crystalline layer deposited on an interior portion of the lattice structure.

12. The article of claim 11, the article further comprising a polymeric material deposited in an interior portion of the lattice structure.

13. The article of claim 8, wherein the metallic nano-crystalline coating comprises:

a first metallic nano-crystalline layer defining a first thickness; and a second metallic nano-crystalline layer defining a second thickness, wherein the first thickness is different than the second thickness.

14. A method for forming an aerospace component comprising:

forming a structured substrate having a macro-porous structure that defines a plurality of pores;

depositing a polymeric material on the structured substrate, wherein the polymeric material at least partially fills the plurality of pores; and depositing a metallic nano-crystalline coating on at least one of at least a portion of the structured substrate or at least a portion the polymeric material, wherein the metallic nano-crystalline coating defines an average grain size less than about 20 nanometers.

15. The method of claim 14, wherein forming a structured substrate comprises: combining a molten metal or a molten metal alloy and a foaming agent to form a metal-based foam.

16. The method of claim 14, wherein forming a structured substrate comprises:

forming a lattice structure, and depositing a metallic nano-crystalline layer on an interior portion of the lattice structure.

17. The method of claim 14, further comprising selectively varying a thickness of the metallic nano-crystalline coating as measured normal to an exterior surface of the structured substrate.

* * * * *